US005402464A

United States Patent [19]

Schenk et al.

[11] Patent Number: 5,402,464

[45] Date of Patent: Mar. 28, 1995

[54] HIGH-VOLTAGE ELECTRONIC TUBE

[75] Inventors: Christian Schenk, Blaustein, Germany; Jens U. Madsen, Lyngby, Denmark

[73] Assignees: Licentia Patent-Verwaltungs-GmbH, Frankfurt am Main, Germany; Andrex Radiation Products A/S, Copenhagen, Denmark

[21] Appl. No.: 127,877

[22] Filed: Sep. 28, 1993

[30] Foreign Application Priority Data

Oct. 2, 1992 [DE] Germany ..... 42 33 206.0
Dec. 10, 1992 [DE] Germany ..... 42 41 572.1

[51] Int. Cl.[6] ..... H01J 35/16

[52] U.S. Cl. ..... 378/136; 378/119; 378/121; 378/139

[58] Field of Search ..... 378/136, 119, 121, 123, 378/139

[56] References Cited

U.S. PATENT DOCUMENTS 3,911,306 10/1975 Peter ..... 378/139
4,618,977 10/1986 Brettschneider et al. ..... 378/139

FOREIGN PATENT DOCUMENTS 0063840 11/1982 European Pat. Off. .
479295 7/1929 Germany .
2300630 12/1976 Germany .
3142281 5/1983 Germany .
2448497 2/1986 Germany .
2506841 7/1986 Germany .
2832318 5/1988 Germany .

*Primary Examiner*—David P. Porta
*Attorney, Agent, or Firm*—Spencer, Frank & Schneider

[57] ABSTRACT

A high-voltage electronic tube includes a housing enclosing a vacuumized space. The housing has a cylindrical metal jacket and an annular insulating disc connected vacuumtight to an inner face of the jacket. An electrode support passes through a central opening of the annular insulating disc and is connected vacuumtight to the annular insulating disc. The electrode support positions an electrode in the vacuumized space. A metal sleeve divides the annular insulating disc into two separate annular disc parts arranged concentrically to the tube axis. The metal sleeve is connected vacuumtight to the annular disc parts.

13 Claims, 1 Drawing Sheet

FIG. 1
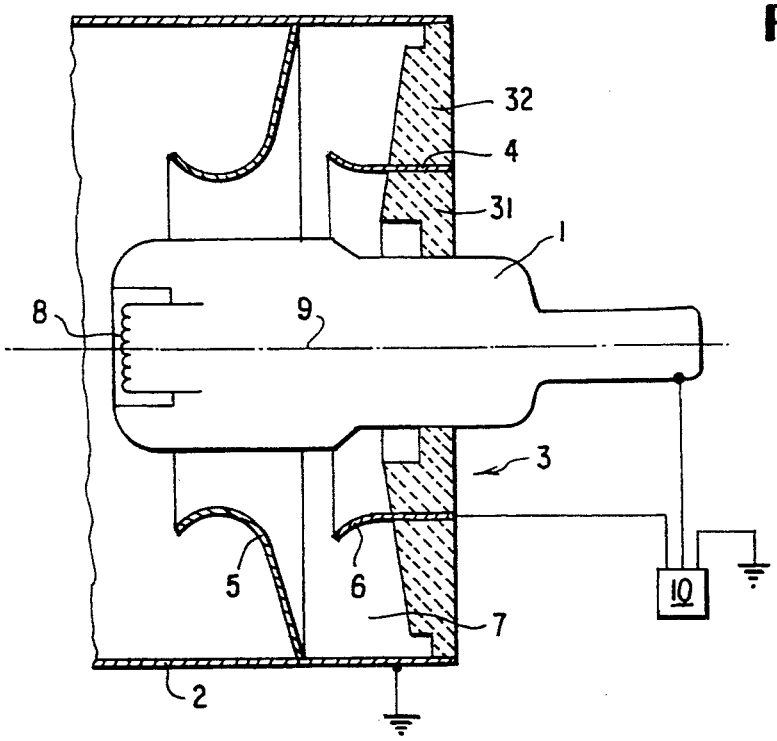
FIG. 2
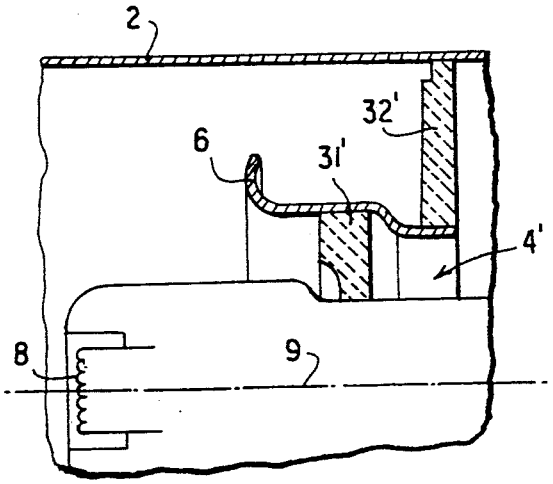
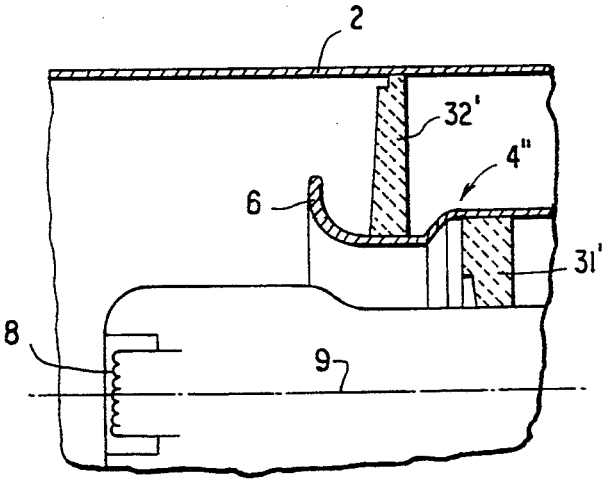
FIG. 3

HIGH-VOLTAGE ELECTRONIC TUBE

CROSS REFERENCE TO RELATED APPLICATION

This application claims the priority of German Application Nos. P 42 33 206.0 filed Oct. 2, 1992 and P 42 41 572.1 filed Dec. 10, 1992, which are incorporated herein by reference.

BACKGROUND OF THE INVENTION

This invention relates to a high-voltage electronic tube such as an X-ray tube of concentric construction, having a vacuumized housing comprising a cylindrical outer metal jacket, an annular ceramic insulating disc and a rod-like or tubular electrode support (guide) which passes centrally through the insulating disc into the jacket interior. A vacuumtight circumferential bond is provided between the outer circumference of the insulating disc and the inner face of the jacket as well as between the inner circumference of the insulating disc and the outer face of the electrode support. An X-ray tube of this type is disclosed, for example, in German Patent No. 2,448,497 and the June 1983 issue of an AEG Telefunken publication entitled "X-ray Tubes in the Metal-Ceramic Technology" (FIG. 3).

In electronic tubes of the above-outlined type it is a desideratum to further improve the high-voltage stability, to reduce the structural space of the tubes and to operate the tubes with increased voltages.

SUMMARY OF THE INVENTION

It is accordingly an object of the invention to provide an improved high-voltage electronic tube of the above-outlined type in which the high-voltage stability is increased as compared to conventional constructions.

This object and others to become apparent as the specification progresses, are accomplished by the invention, according to which, briefly stated, a metal sleeve separates the insulating disc into two radially adjacent annular portions which are concentric to the longitudinal tube axis. The metal sleeve is connected vacuumtight to the two annular portions.

The metal sleeve effects a homogenization of the electric field and reduces the risk that, particularly in the securing zone of the electrode support at the inner circumference of the annular insulating disc irregular and increased field stresses occur which may lead to high-voltage breakdown.

BRIEF DESCRIPTION OF THE DRAWINGS

FIG. 1 is an axial sectional view of a first preferred embodiment of the invention.

FIGS. 2 and 3 are fragmentary axial sectional views of two additional preferred embodiments of the invention.

DESCRIPTION OF THE PREFERRED EMBODIMENTS

FIG. 1 shows the cathode-side end of an X-ray tube. The vacuumized housing is formed of an essentially cylindrical outer metal jacket 2, a ceramic annular insulating disc 3 and an electrode support (guide-through) 1 of tubular configuration passing through the central opening of the insulator 3 and positioning the cathode spiral 8 within the vacuum space 7. The metal-to-ceramic connections are vacuumtight and may be, for example, soldered bonds. Conventionally, the metal outer jacket 2 is grounded and the cathode support 1 is at a negative potential of significant magnitude, for example, −300 to −450 kV. At the inner face of the outer jacket 2 an annular extension 5 may be provided which shields against secondary electrons. The electron tube has an essentially rotationally symmetrical construction with respect to the longitudinal tube axis 9.

For improving the high-voltage stability, particularly for homogenizing and reducing the field strength in the zone of the connection between the electrode support 1 and the ceramic insulating disc 3, the latter is divided into two radially adjacent annular parts 31 and 32 by means of a tubular metal portion (metal sleeve) 4. The annular parts are concentric with the tube axis 9. Thus, as seen in FIG. 1, the annular part 32 radially separates the sleeve 4 from the jacket 2. Stated differently, the sleeve 4 is at a radial clearance from the jacket 2. The connections between the sleeve 4 and the ceramic disc parts 31 and 32 are vacuumtight and are preferably solder connections. The sleeve 4 within the vacuumized space 7 has a flaring, funnel-shaped free end portion 6 which forms a shield and which affects the electric field. On the sleeve 4 which is rotationally symmetrically arranged relative to the longitudinal tube axis 9, a predetermined potential appears, effecting a certain homogenization of the high-voltage electric field between the outer jacket 2 and the cathode support 1.

Advantageously, a potential is applied by a power supply 10 to the sleeve 4 from the exterior. This may be effected without difficulties because the sleeve 4 passes from the vacuumized space 7 to the outside and may thus be readily contacted there. By an appropriate selection of the voltage applied exteriorly to the sleeve 4 the electric field strength in the critical zone of the cathode support 1 may be reduced. Such an exteriorly applied voltage, however, must have a magnitude between the voltages applied to the cathode support 1 and the outer jacket 2. Dependent upon the diameter of the sleeve 4 as compared to the diameters of the electrode support 1 and the outer jacket 2, the voltage applied to the sleeve 4 may be, for example, −200 kV assuming that a voltage of −400 kV is applied to the electrode support 1 and the outer jacket 2 is grounded. Thus, the potential applied to the sleeve 4 is more positive than that applied to the cathode support 1 and more negative than that applied to the outer jacket 2. Assuming an optimal positioning of the sleeve 4 and an optimal potential applied thereto, the field strength in the particularly critical region where the electrode support 1 passes through the ceramic disc 3 is reduced by up to 30%.

It may be of advantage to divide the insulating disc 3 into three or more concentric annular insulating parts by two or more sleeves. It is also feasible to constitute the sleeve 4 merely of a soldering metal layer by means of which the concentric annular parts 31 and 32 are connected to one another in a vacuumtight manner.

Turning to the embodiment illustrated in FIG. 2, the concentric annular insulating parts 31′ and 32′ are axially offset, defining an axial clearance therebetween and are overlapping in the radial direction, that is, the inner diameter of the outer annular part 32′ is smaller than the outer diameter of the inner annular part 31′. The annular part 31′, having the greater outer diameter of the two parts 31 and 32 is arranged closer to the cathode 8 than the part 32′.

The embodiment according to FIG. 3 differs from that of FIG. 2 in that the annular insulator part 32′ having the smaller inner diameter of the two parts 31′ and 32′ is situated axially closer to the cathode 8 than the other annular part 31′.

In both embodiments of FIGS. 2 and 3 the respective metal separating sleeves 4′ and 4″ have two adjoining length portions of different diameters to accommodate the unlike diametral dimensions of the annular parts 31′ and 32′. In FIGS. 2 and 3, similarly to FIG. 1, the cathode side region of an X-ray tube constructed in a rotationally symmetrical manner is illustrated.

The potential applied to the metal separating sleeves 4, 4′, 4″ is expediently selected as a function of the maximum field strength which prevails at the outer annular insulating part, that is, at the outer surface of the metal separating sleeves.

It will be understood that the above description of the present invention is susceptible to various modifications, changes and adaptations, and the same are intended to be comprehended within the meaning and range of equivalents of the appended claims.

What is claimed is:

1. In a high-voltage electronic tube having a longitudinal tube axis and including a housing enclosing a vacuumized space; said housing having a cylindrical metal jacket and an annular insulating disc having an outer periphery connected vacuumtight to an inner face of the jacket;

an electrode support passing through a central opening of the annular insulating disc and being connected vacuumtight to an inner periphery of the annular insulating disc; and an electrode positioned by said electrode support;

the improvement comprising at least one metal sleeve dividing said annular insulating disc into at least two separate annular disc parts arranged concentrically to said tube axis; said metal sleeve being connected vacuumtight to said annular disc parts and being at a radial clearance from said jacket.

2. The high-voltage electronic tube as defined in claim 1, further comprising means for applying to said electrode support a potential which is significantly more negative than a potential applied to said jacket.

3. The high-voltage electronic tube as defined in claim 1, wherein said metal sleeve comprises a portion projecting beyond said annular insulating disc into said vacuumized space.

4. The high-voltage electronic tube as defined in claim 3, wherein said portion of said metal sleeve has a flaring, funnel-shaped free end.

5. The high-voltage electronic tube as defined in claim 1, further comprising means for applying different potentials to said metal sleeve, said jacket and said electrode support; the potential on said metal sleeve being more positive than the potential on said electrode support and more negative than the potential on said jacket.

6. The high-voltage electronic tube as defined in claim 1, wherein said high-voltage electronic tube is an X-ray tube and said electrode is a cathode supported by said electrode support.

7. The high-voltage electronic tube as defined in claim 1, wherein said annular disc parts are axially staggered relative to one another.

8. The high-voltage electronic tube as defined in claim 7, wherein one of said annular disc parts is an outer annular disc part and one of the annular disc parts is an inner annular disc part; each annular disc part having an inner and an outer diameter; the inner diameter of said outer annular disc part being less than the outer diameter of said inner annular disc part.

9. The high-voltage electronic tube as defined in claim 7, wherein one of said annular disc parts is an outer annular disc part and one of said annular disc parts is an inner annular disc part; said inner annular disc part being located closer to said electrode than said outer annular disc part.

10. The high-voltage electronic tube as defined in claim 7, wherein one of said annular disc parts is an outer annular disc part and one of said annular disc parts is an inner annular disc part; said inner annular disc part being located farther from said electrode than said outer annular disc part.

11. The high-voltage electronic tube as defined in claim 7, wherein said annular disc parts are at an axial clearance from one another.

12. In a high-voltage electronic tube having a longitudinal tube axis and including a housing enclosing a vacuumized space; said housing having a cylindrical metal jacket and an annular insulating disc having an outer periphery connected vacuumtight to an inner face of the jacket;

an electrode support passing through a central opening of the annular insulating disc and being connected vacuumtight to an inner periphery of the annular insulating disc; and an electrode positioned by said electrode support;

the improvement comprising at least one metal sleeve dividing said annular insulating disc into at least two separate annular disc parts arranged concentrically to said tube axis and being axially staggered relative to one another; said metal sleeve being connected vacuumtight to said annular disc parts; one of said annular disc parts being an outer annular disc part and one of said annular disc parts being an inner annular disc part; each said annular disc part having an inner and an outer diameter; the inner diameter of said outer annular disc part being less than the outer diameter of said inner annular disc part.

13. In a high-voltage electronic tube having a longitudinal tube axis and including a housing enclosing a vacuumized space; said housing having a cylindrical metal jacket and an annular insulating disc having an outer periphery connected vacuumtight to an inner face of the jacket;

an electrode support passing through a central opening of the annular insulating disc and being connected vacuumtight to an inner periphery of the annular insulating disc; and an electrode positioned by said electrode support;

the improvement comprising (a) at least one metal sleeve dividing said annular insulating disc into at least two separate annular disc parts arranged concentrically to said tube axis; said metal sleeve being connected vacuumtight to said annular disc parts; and (b) means for applying different potentials to said metal sleeve, said jacket and said electrode support; the potential on said metal sleeve being more positive than the potential on said electrode support and more negative than the potential on said jacket.

* * * * *